US005722906A

United States Patent [19]

Gentile

[11] Patent Number: 5,722,906

[45] Date of Patent: Mar. 3, 1998

[54] GAME BALL

[76] Inventor: Robert Gentile, 30 Wyman St., Billerica, Mass. 01821

[21] Appl. No.: 538,032

[22] Filed: Sep. 29, 1995

Related U.S. Application Data

[63] Continuation of Ser. No. 215,892, Mar. 21, 1994, abandoned.

[51] Int. Cl.[6] ..... A63B 43/04; A63B 37/08

[52] U.S. Cl. ..... 473/471; 473/594; 273/DIG. 20

[58] Field of Search ..... 273/58 H, DIG. 20; 473/594, 471

[56] References Cited

U.S. PATENT DOCUMENTS

| | | | |
|---|---|---|---|
| 1,991,671 | 2/1935 | Hodson | 273/58 F X |
| 2,670,206 | 2/1954 | Brewster | 273/58 H X |
| 4,119,315 | 10/1978 | Goldfarb | 273/58 F X |
| 4,244,855 | 1/1981 | Cox et al. | 273/231 X |
| 4,448,418 | 5/1984 | McNeill | 273/58 H X |
| 4,872,676 | 10/1989 | Townsend | 273/58 H |
| 5,149,096 | 9/1992 | Keating | 273/128 R |
| 5,516,098 | 5/1996 | Aiello | 273/58 H X |

*Primary Examiner*—George J. Marlo

[57] ABSTRACT

A ball for use in street hockey comprised of a hollow sphere and a freely moving liquid contained within a volume of the sphere. The sphere having a smooth, unobstructed and spherical inner surface and being constructed of a bounce resistant material. The liquid, most preferably non-toxic liquid antifreeze, occupying less than one-half of the volume of the sphere and serving to dampen energy and to lower the center of gravity of the ball below its geometric center.

1 Claim, 1 Drawing Sheet

GAME BALL

This application is a continuation of application Ser. No. 08/215,892, filed Mar. 21, 1994, now abandoned.

FIELD OF THE INVENTION

This invention relates to sports objects which are hit along surface with a stick.

BACKGROUND OF THE INVENTION

Ice Hockey is a game played on ice with a puck—a disk shaped object which is hit with a hockey stick. The puck, which slides on the ice, has a center of gravity about 1 cm above the ice surface.

Street hockey is a game modeled after ice hockey which can be played when no ice surface is available. It is played with a ball. The ball is manufactured of a hard bounce resistant polymer and is about six cm in diameter. This means the center of gravity is about three cm above the surface on which the game is played. Further, the polymer still has a tendency to bounce.

Liquid filled golf balls exist. The liquid in the golf balls fills the entire center of the golf ball providing a center of gravity at the exact center of the ball. The purpose of such liquid is to control the spin of the ball during flight. Such a ball is described in U.S. Pat. No 4,244,855.

A toy is available under the name BALZAC. This ball consists of a cloth pouch and a balloon for placement inside the ball. The balloon may be inflated with either water, air, a combination, and/or other objects such as beans. When inflated, the ball is tossed through the air. The soft surface reduces injury risk as it is tossed at head level. This ball is not suitable for street hockey because the stick would damage the ball and because the soft surface results in less elastic collisions which poorly simulate ice hockey.

Another toy ball has been sold under the name of OOPIE, from Parker Brothers. This ball is an inflatable ball having a pocket on a single area of the surface to hold fluid. This destabilizes the ball when tossed, causing erratic movement. The inelastic surface produced by a thin inflatable ball reduces the risk of injury as it is tossed at head level. However, such a ball would not be suitable for playing hockey, since it the stick would damage the ball; its path is erratic, and because less elastic collisions between the ball and the stick poorly simulate ice hockey.

A third toy ball is available from Jackson Smith Company called an Eerie Eyeball. This toy is described as follows "Plastic case hods an eerie eye floating in liquid, so it spins and jiggles all the way. About 1" in diameter." The "eye" is a hollow plastic sphere which is weighted to maintain a stare upward. It floats in an outer spherical plastic case which is filled except for a small bubble at the top about 1 cm in diameter. This novelty would not be suitable for playing street hockey because the thin plastic shell would break, and the size is too small.

SUMMARY OF THE INVENTION

The ball of the present invention has a hard, sturdy, bounce resistant shell which contains a freely moving liquid resting in the lower half of the ball. The preferred ball is partially filled with liquid which is free to move. This low resistance to free movement enables a substantially constantly lowered. center of gravity during movement of the ball, reduces bounce, and more nearly simulates the behavior of a puck moved about by a stick.

DETAILED DESCRIPTION OF THE INVENTION

Figure 1:
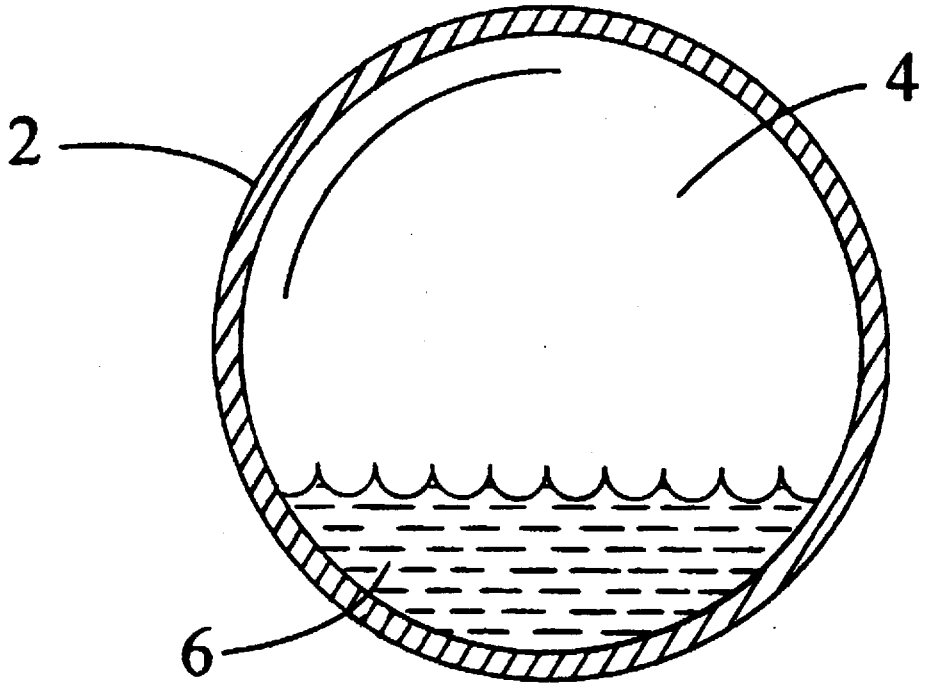
FIG. 1 is a cross sectional view of a ball according to the invention.

The ball shown in FIG. 1 is suitable for playing street hockey, a game played with modified hockey sticks on pavement. The ball is spherical and has a "dead" outer shell 2, preferably having a diameter similar to that of a hockey puck, about 6 cm. "Dead" refers to the fact that shell 2 of the ball is chosen to have minimal bounce. The shell 2 has a spherical cavity into which a liquid 6 is located. The preferred liquid is a nontoxic antifreeze. Such antifreeze is available for use in RVs (recreational vehicles). The liquid 6 fills less than half of the spherical cavity. The remainder of the cavity is filled with a gas 4 such as air. This allows the liquid to freely move in the cavity. Since liquid sinks to below gas, the center of gravity tends to remain low. This better simulates a hockey puck. It is preferred that the center of gravity approach 1 cm. from a surface upon which the ball rests.

The present invention provides users with a multiplicity of advantages particularly useful in street hockey applications. By lowering the center of gravity in a ball specially designed for use in street hockey to some point below the geometric center of the ball, the invention causes the ball to tend to exhibit a lower, more controlled flight trajectory. When a user strikes the ball with a hockey stick, the center of gravity of the ball is more likely to be below the point of impact of the stick face and the ball. Unlike standard hockey balls which tend to lift and then fly uncontrollably, the flight trajectory of hockey balls employing the present invention tends to be lower, and a lower flight trajectory allows for more controlled and more accurate shooting. As a result, safety for users is increased, and accidental damage to the playing environment (i.e. windows) is reduced.

By providing the inner cavity with a smooth inner surface (as is shown in FIG. 1) and a liquid which is freely moving, the advantages gained by the invention are increased further. Since the liquid is freely moving and unobstructed, it quickly returns to substantially its rest position after the ball is struck. As a result, the lowered flight path of the ball is straighter than might otherwise be the case if the liquid did not settle quickly. Also, the quick settling of the liquid allows the ball's handling characteristics (i.e. lowered flight trajectory) to be repeatable nearly immediately even should the ball still be spinning after being struck. One will note that this rapid settling is of great importance in a fast moving sport such as street hockey. Still further, the sloshing liquid acts as an excellent dampener of energy as the ball strikes the ground. In combination with the specially chosen bounce-resistant shell material, this dampening phenomena results in a ball having a tremendously reduced tendency to bounce. In street hockey, reduced bounce equals a more hittable and controllable ball.

As is set forth above, the preferred embodiment of the invention employs non-toxic antifreeze as the liquid which lowers the balls center of gravity, increases control, and reduces bounce. The antifreeze is particularly useful for this application since its viscosity is relatively low and varies little with temperature so that, whether the ball is used in winter or summer, the ball's improved performance is substantially unaffected.

A first prototype ball was made from an old tennis ball, into which a nontoxic antifreeze was injected until the weight of the ball and a hockey puck was matched. This ball, even with undesirable bouncing characteristics associated with tennis balls, was found to be much more controllable for playing street hockey than the balls sold for such purposes.

A second prototype was made using a ball sold specifically for use in street hockey. The antifreeze was injected into the ball to a height of about one third the diameter of the ball. The ball has diameter equal to that of a hockey puck. The ball had excellent handling characteristics.

What is claimed is:

1. A game ball in the shape of a sphere for use in playing street hockey, the game ball consisting of a hard, rigid spherical shell enclosing a cavity, and a non-toxic liquid antifreeze contained in said cavity, the spherical shell having a smooth unobstructed spherical inner surface, and the non-toxic liquid antifreeze occupying less than one-half of the volume of said cavity whereby the center of gravity of said game ball is below the geometric center of said game ball and the non-toxic liquid antifreeze moves freely over the spherical inner surface of said game ball during movement of the game ball over a playing surface.

* * * * *